US009097498B2

(12) United States Patent
Burtan

(10) Patent No.: US 9,097,498 B2
(45) Date of Patent: Aug. 4, 2015

(54) MECHANISM FOR RAISING AND LOWERING A WEAPONRY TARGET

(75) Inventor: Blair Medford Burtan, Prescott, AZ (US)

(73) Assignee: BIRCHWOOD LIMITED, Prescott, AZ (US)

( * ) Notice: Subject to any disclaimer, the term of this patent is extended or adjusted under 35 U.S.C. 154(b) by 126 days.

(21) Appl. No.: 13/603,672

(22) Filed: Sep. 5, 2012

(65) Prior Publication Data

US 2014/0062023 A1 Mar. 6, 2014

(51) Int. Cl.

| | |
|---|---|
| ***F41J 1/10*** | (2006.01) |
| ***F41J 7/02*** | (2006.01) |
| ***F41J 11/02*** | (2009.01) |
| ***F41J 7/06*** | (2006.01) |
| ***F41J 7/04*** | (2006.01) |

(52) U.S. Cl.

CPC ..... *F41J 7/06* (2013.01); *F41J 7/04* (2013.01)

(58) Field of Classification Search

USPC ..... 273/387, 388, 389, 390, 392, 393, 394, 273/400, 401, 403, 404, 406, 407; 296/176, 296/20; 434/21; 5/118, 610; 73/167; 89/132; 108/116, 147, 2; 254/122

See application file for complete search history.

(56) References Cited

U.S. PATENT DOCUMENTS

| | | | | | |
|---|---|---|---|---|---|
| 78,250 | A | * | 5/1868 | Withey | 108/116 |
| 136,357 | A | * | 3/1873 | Belford | 108/116 |
| 213,512 | A | * | 3/1879 | Landis | 297/338 |
| 226,053 | A | * | 3/1880 | Finnegan | 108/138 |
| 300,683 | A | * | 6/1884 | Morrison | 112/228 |
| 499,315 | A | * | 6/1893 | Borchardt | 89/132 |
| 541,360 | A | * | 6/1895 | Kaysan | 5/610 |
| 544,821 | A | * | 8/1895 | Morrison | 108/116 |
| 692,332 | A | * | 2/1902 | Orr et al. | 105/316 |
| 722,166 | A | * | 3/1903 | Taft | 254/8 R |
| 848,332 | A | * | 3/1907 | Westervelt | 254/8 R |
| 910,210 | A | * | 1/1909 | McCenzie | 254/390 |
| 2,545,515 | A | * | 3/1951 | Mast et al. | 108/138 |
| 2,675,285 | A | * | 4/1954 | Terry et al. | 5/618 |
| 3,000,683 | A | * | 9/1961 | MacNeary | 312/235.3 |
| 3,711,876 | A | * | 1/1973 | Kirkland et al. | 5/610 |
| 3,733,073 | A | * | 5/1973 | Gutler | 273/406 |
| 3,760,436 | A | * | 9/1973 | Zach et al. | 5/118 |
| 4,190,280 | A | * | 2/1980 | Donohoe | 296/20 |
| 4,934,937 | A | * | 6/1990 | Judd | 434/21 |
| 5,222,741 | A | * | 6/1993 | Redl | 273/393 |
| 5,598,591 | A | * | 2/1997 | Kelley | 5/118 |
| 5,603,505 | A | * | 2/1997 | Acock | 273/391 |
| 5,720,059 | A | * | 2/1998 | Allevato et al. | 5/610 |

(Continued)

*Primary Examiner* — Gene Kim
*Assistant Examiner* — M Chambers
(74) *Attorney, Agent, or Firm* — Bennet K. Langlotz; Langlotz Patent & Trademark Works, Inc.

(57) ABSTRACT

A weaponry target mechanism has a base having two pivot points, two support arms each pivotally connected to one of the pivot points, a third arm pivotally connected to the two support arms, and a platform pivotally connected to the third arm and pivotally connected by a fourth arm to one of the support arms. The base may have two additional pivot points. There may be two additional support arms each pivotally connected to one of the additional pivot points. There may be an additional third arm pivotally connected to the two additional support arms. The platform may also be pivotally connected to the additional third arm and pivotally connected by an additional fourth arm to one of the additional support arms. There may be a target attached to the platform. The target may assume an upright position and a dropped position.

23 Claims, 12 Drawing Sheets

(56) References Cited

U.S. PATENT DOCUMENTS 5,816,579 A * 10/1998 Broussard et al. ..... 273/408
6,851,144 B2 * 2/2005 Wang ..... 5/610
7,654,208 B2 * 2/2010 Patten ..... 108/96
2003/0071472 A1 * 4/2003 Henderson et al. ..... 296/20
2014/0062023 A1 * 3/2014 Burtan ..... 273/407

* cited by examiner

MECHANISM FOR RAISING AND LOWERING A WEAPONRY TARGET

FIELD OF THE INVENTION

The present invention relates to weaponry targets, and more particularly to a weaponry target mechanism that maintains the target's center of mass over the mechanism even in the dropped position.

BACKGROUND OF THE INVENTION

Automated weaponry targets have long been known and widely used at civilian, law enforcement, and military shooting ranges. Although such devices have achieved considerable popular and commercial success, there is much room for improvement. Existing systems present the target mannequin in a fully vertical (standing) position. After the target mannequin is hit, the mannequin drops to a fully horizontal position to indicate a kill. These existing systems require considerable physical space to permit the mannequin to drop. Furthermore, the center of mass of such systems shifts dramatically between the upright and dropped positions. The change in the position of the center of mass interferes with use of such systems on moving platforms. Finally, the devices offer no control over the speed or intermediate position of the target mannequin as the mannequin drops.

Although these designs are effective for their intended purpose, they are limited to use where considerable space is available and where the target is mounted on a stationary platform.

Therefore, a need exists for a new and improved weaponry target mechanism that maintains the target's center of mass over a mechanism even in the dropped position. In this regard, the various embodiments of the present invention substantially fulfill at least some of these needs. In this respect, the weaponry target mechanism according to the present invention substantially departs from the conventional concepts and designs of the prior art, and in doing so provides an apparatus primarily developed for the purpose of maintaining the target's center of mass over the mechanism even in the dropped position.

SUMMARY OF THE INVENTION

The present invention provides an improved weaponry target mechanism, and overcomes the above-mentioned disadvantages and drawbacks of the prior art. As such, the general purpose of the present invention, which will be described subsequently in greater detail, is to provide an improved weaponry target mechanism that has all the advantages of the prior art mentioned above.

To attain this, the preferred embodiment of the present invention essentially comprises a base having two pivot points, two support arms each pivotally connected to one of the pivot points, a third arm pivotally connected to the two support arms, and a platform pivotally connected to the third arm and pivotally connected by a fourth arm to one of the support arms. The base may have two additional pivot points. There may be two additional support arms each pivotally connected to one of the additional pivot points. There may be an additional third arm pivotally connected to the two additional support arms. The platform may also be pivotally connected to the additional third arm and pivotally connected by an additional fourth arm to one of the additional support arms. There may be a target attached to the platform. The target may assume an upright position and a dropped position. There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

The same reference numerals refer to the same parts throughout the various figures.

DESCRIPTION OF THE CURRENT EMBODIMENT

Figure 1:
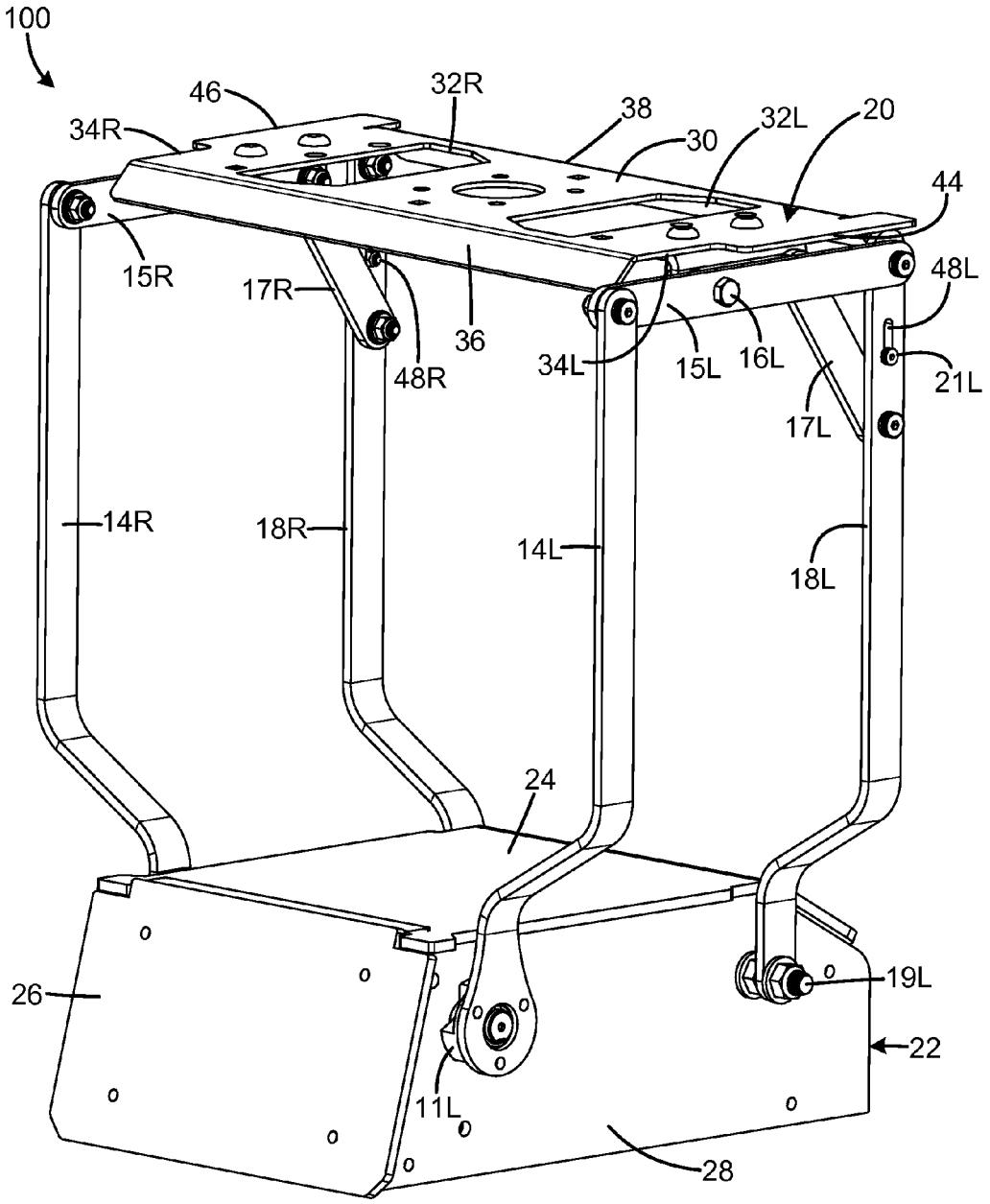
FIG. 1 is a top perspective view of the current embodiment of a weaponry target mechanism constructed in accordance with the principles of the present invention in the upright position.

An embodiment of the weaponry target mechanism of the present invention is shown and generally designated by the reference numeral 100.

FIG. 1 illustrates the improved weaponry target mechanism 100 of the present invention. More particularly, the mechanism is shown without a target mannequin attached. The mechanism is depicted in the upright position.

The upper portion of the mechanism 100 has a generally rectangular target mounting plate or platform 20 with a front 36, rear 38, left 44, right 46, top 30, and bottom 40. The front of the left and right sides of the mounting plate define recesses 34R, 34L. The front and rear of the mounting plate are bent downward at about a 45° angle. A number of mounting features are present on the mounting plate to permit releasable attachment of a target mannequin. These include leg holes 32R, 32L and a central aperture 48. The bottom has two mounting brackets 46R, 46L attached to the left and right sides (shown in FIG. 5). The bottom rear of the mounting plate rests on the upper end of the rear support arms 18R, 18L when the mechanism is in the upright position.

The front portion of the mounting brackets 46R, 46L is pivotally connected to a middle portion of upper pivot supports 15R, 15L by pivot shafts 16R, 16L so that the mounting plate 20 can rotate freely. The rear end of the upper pivot supports is pivotally connected to the upper end of the rear support arms 18R, 18L by pivot shafts. The front end of the upper pivot supports is pivotally attached to one end of main pivot arms 14R, 14L.

The rear portion of the mounting brackets 46R, 46L is pivotally connected to the upper end of tilt linkage arms 17R, 17L by pivot shafts. The lower end of the tilt linkage arms is pivotally connected to a middle portion of the rear support arms 18R, 18L by pivot shafts. The lower end of the main pivot arms 14R, 14L is connected to hubs 11R, 11L. The lower end of the rear support arms is pivotally attached to rear pivots 19R, 19L.

The rear support arms 18R, 18L each define a slot 48R, 48L located between the attachment points of the tilt linkage arms 17R, 17L and the upper pivot supports 15R, 15L. Each slot receives a motion stop 21R, 21L.

The hubs 11R, 11L and pivots 19R, 19L protrude from the left cover 28 and right cover 44 (shown in FIG. 5) of housing 22. The housing 22 also has a top cover 24, a front cover 26, and a rear cover 42. The housing serves as a base for the mechanism 100. The combination of a main pivot arm, upper pivot support, rear support arm, and the housing forms a four-sided polygon with a pivot point at each corner on either side of the mounting plate 20.

Figure 2:
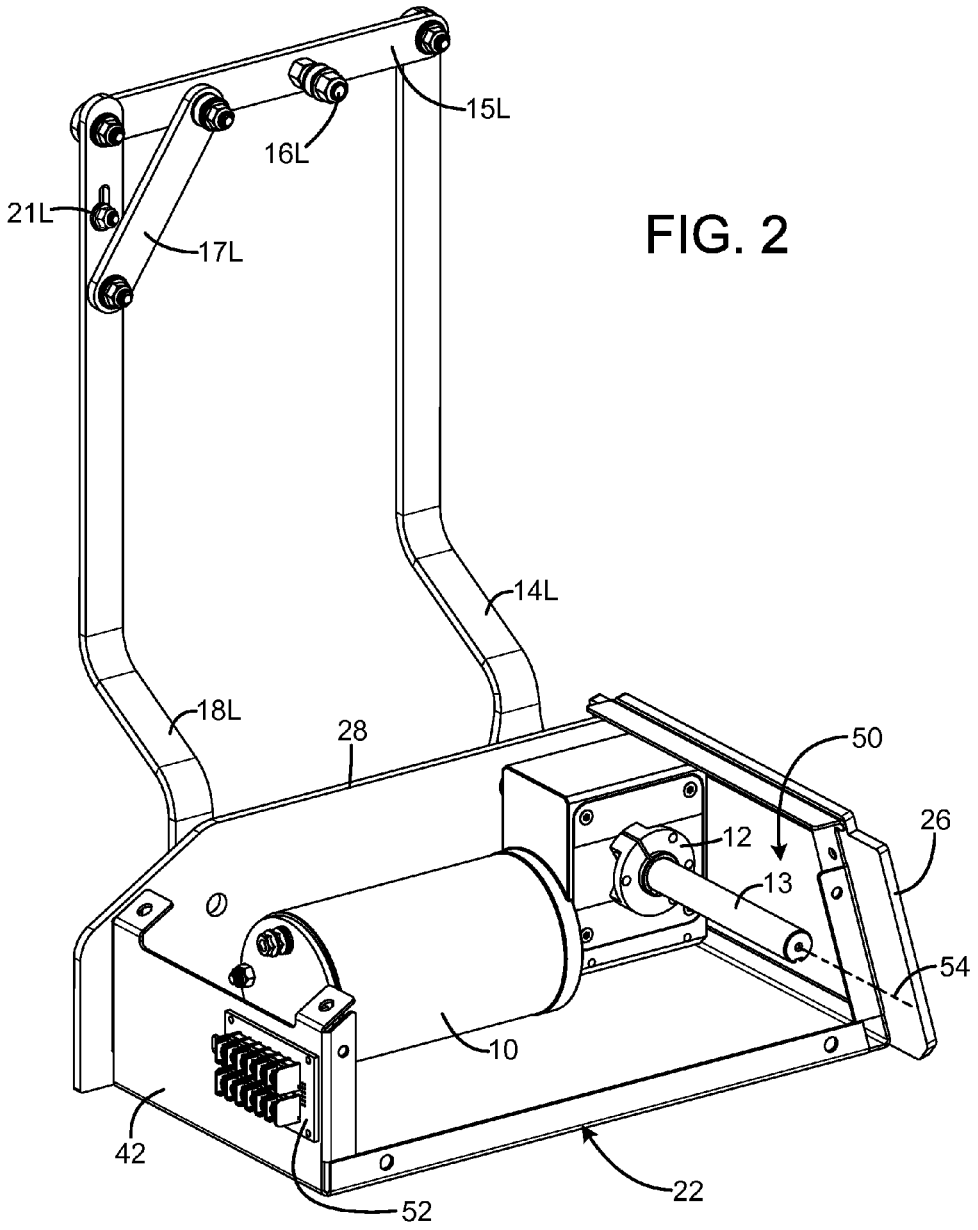
FIG. 2 is a top perspective view of the weaponry target mechanism of FIG. 1 with various components removed to expose the interior of the housing.

FIG. 2 illustrates the improved weaponry target mechanism 100 of the present invention. More particularly, the mechanism is shown with the top cover 24 and the right cover 44 and associated parts removed to expose the interior 50 of the housing 22.

The interior 50 of the housing 22 receives an actuator 10 that drives a shaft 13. A position feedback sensor 12 mounted on the shaft provides accurate position information to control electronics 52 mounted on the rear cover 42. The shaft 13 is connected to the hubs 11R, 11L.

Figure 3:
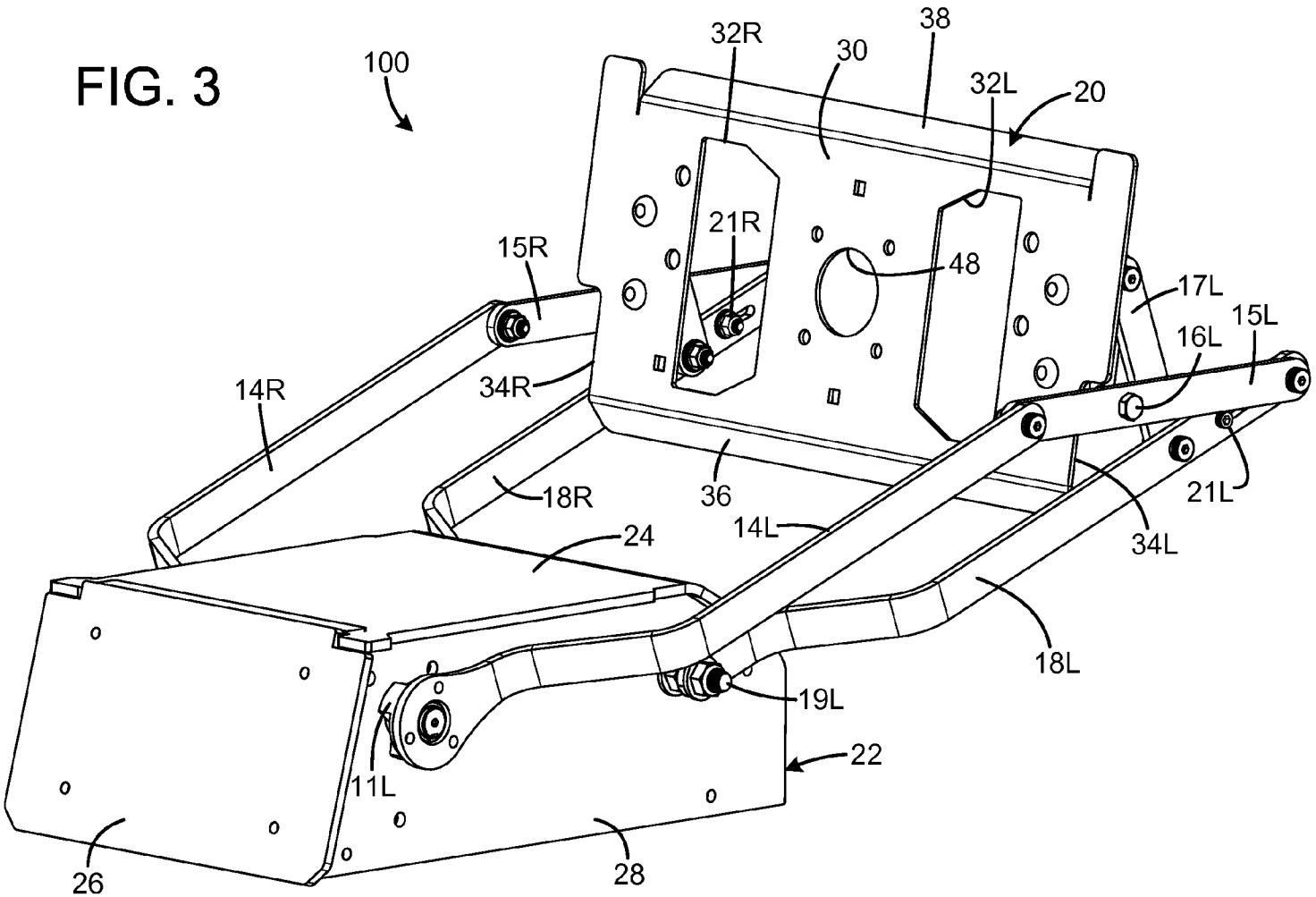
FIG. 3 is a top perspective view of the weaponry target mechanism of FIG. 1 in the dropped position.
Figure 4:
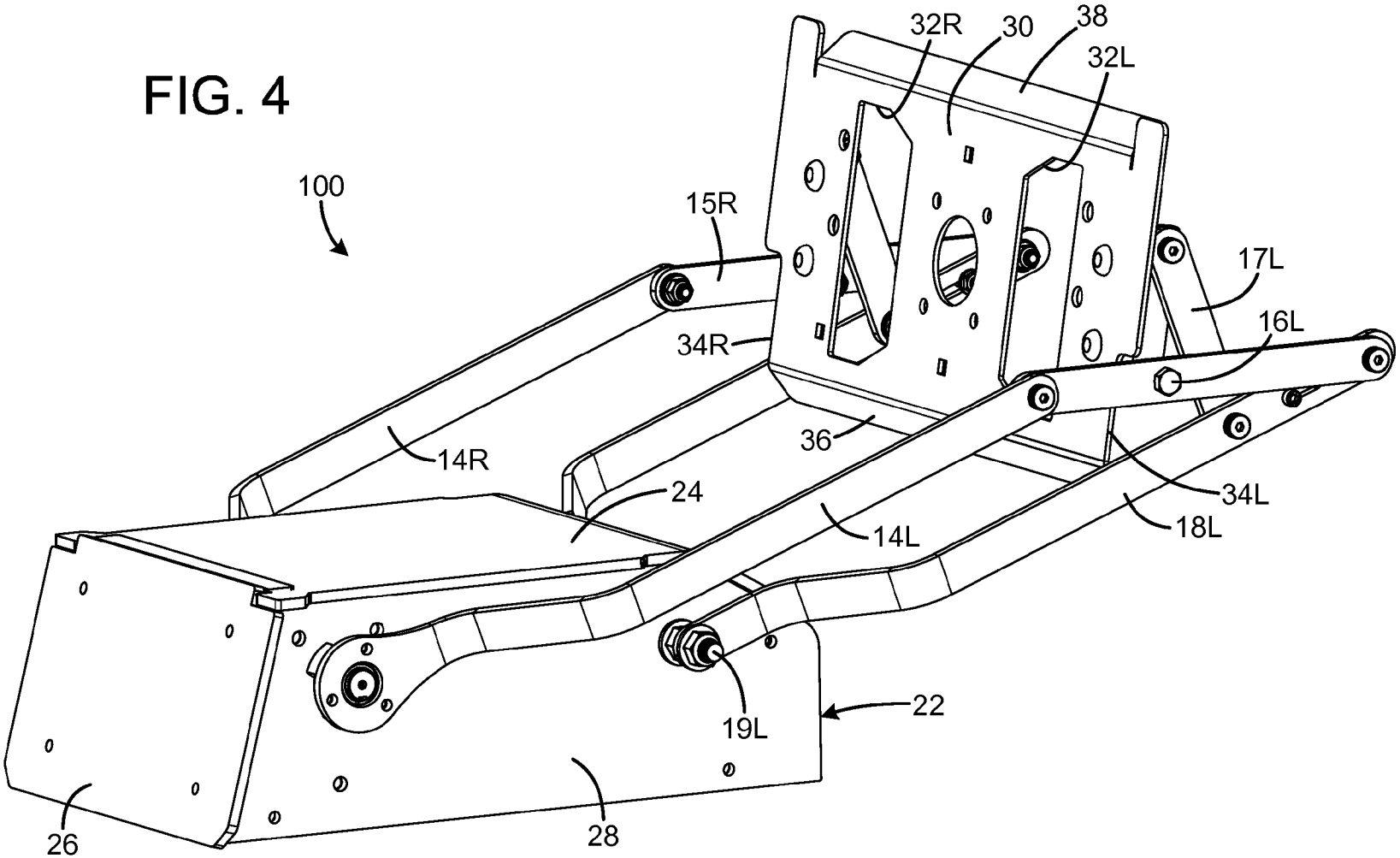
FIG. 4 is a top perspective view of the weaponry target mechanism of FIG. 3 rotated clock wise.
Figure 5:
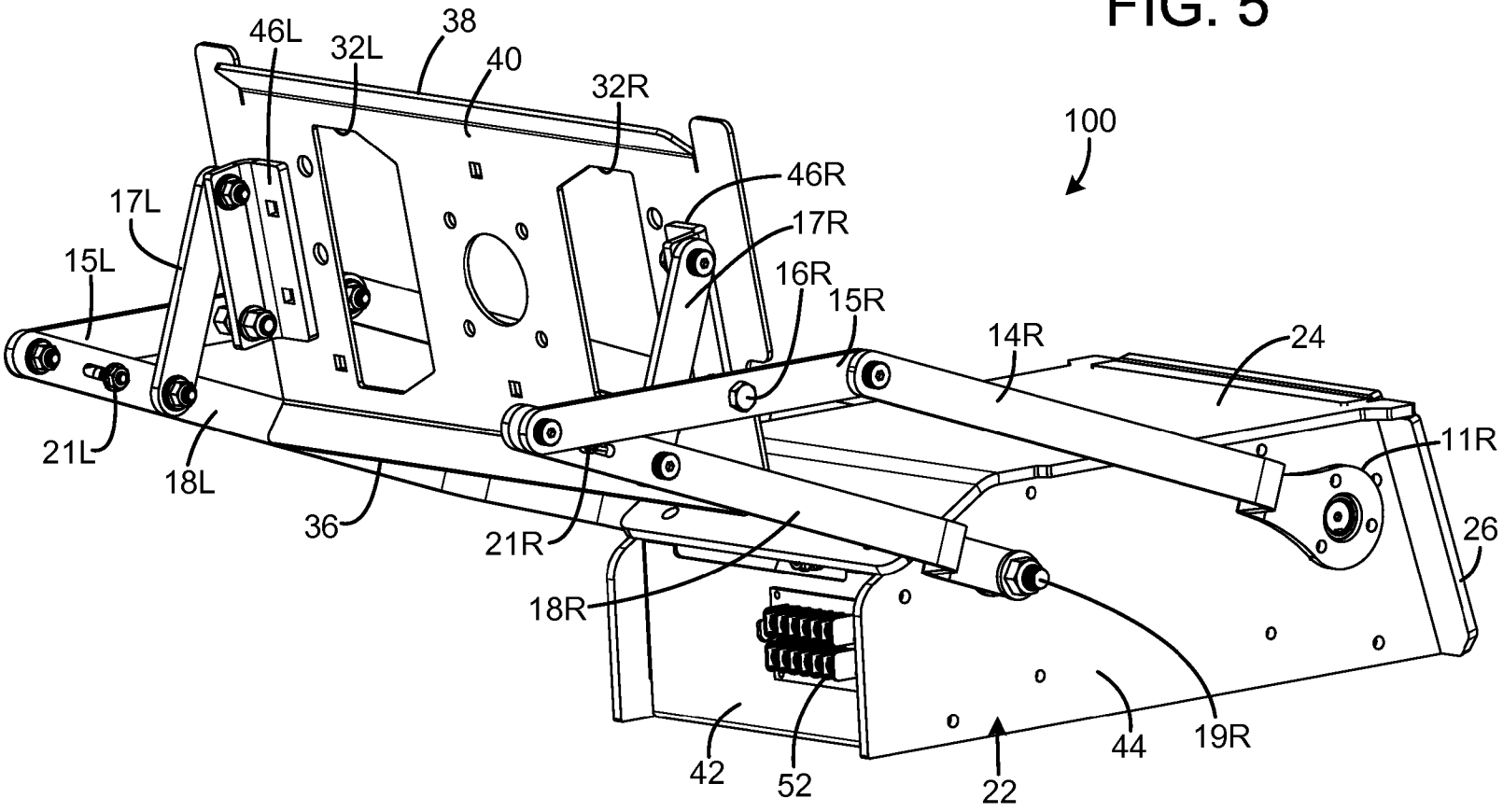
FIG. 5 is a rear perspective view of FIG. 3 in the dropped position.

FIGS. 3-5 illustrate the improved weaponry target mechanism 100 of the present invention. More particularly, the mechanism is shown in the dropped position. Since the hubs 11R, 11L connected to the lower end of the main pivot arms 14R, 14L, rotational motion of the shaft causes the main pivot arms to rotate about the shaft's longitudinal axis 54. This rotation induces rotation of the rear support arms 18R, 18L about the rear pivots 19R, 19L because of the connections between the main pivot arms, upper support pivots 15R, 15L, and rear support arms.

As the angle between the upper pivot supports 15R, 15L and the rear support arms 18R, 18L changes, the tilt linkage arms 17R, 17L cause the target mounting plate 20 to rotate about pivot shafts 16R, 16L in a direction opposite that of the main pivot arms 14R, 14L. The motion stops 21R, 21L prevent the rear support arms from rotating more than a desired amount. The recesses 34R, 34L on either side of the mounting plate 20 provide clearance for the upper support pivots 15R, 15L.

Figure 6:
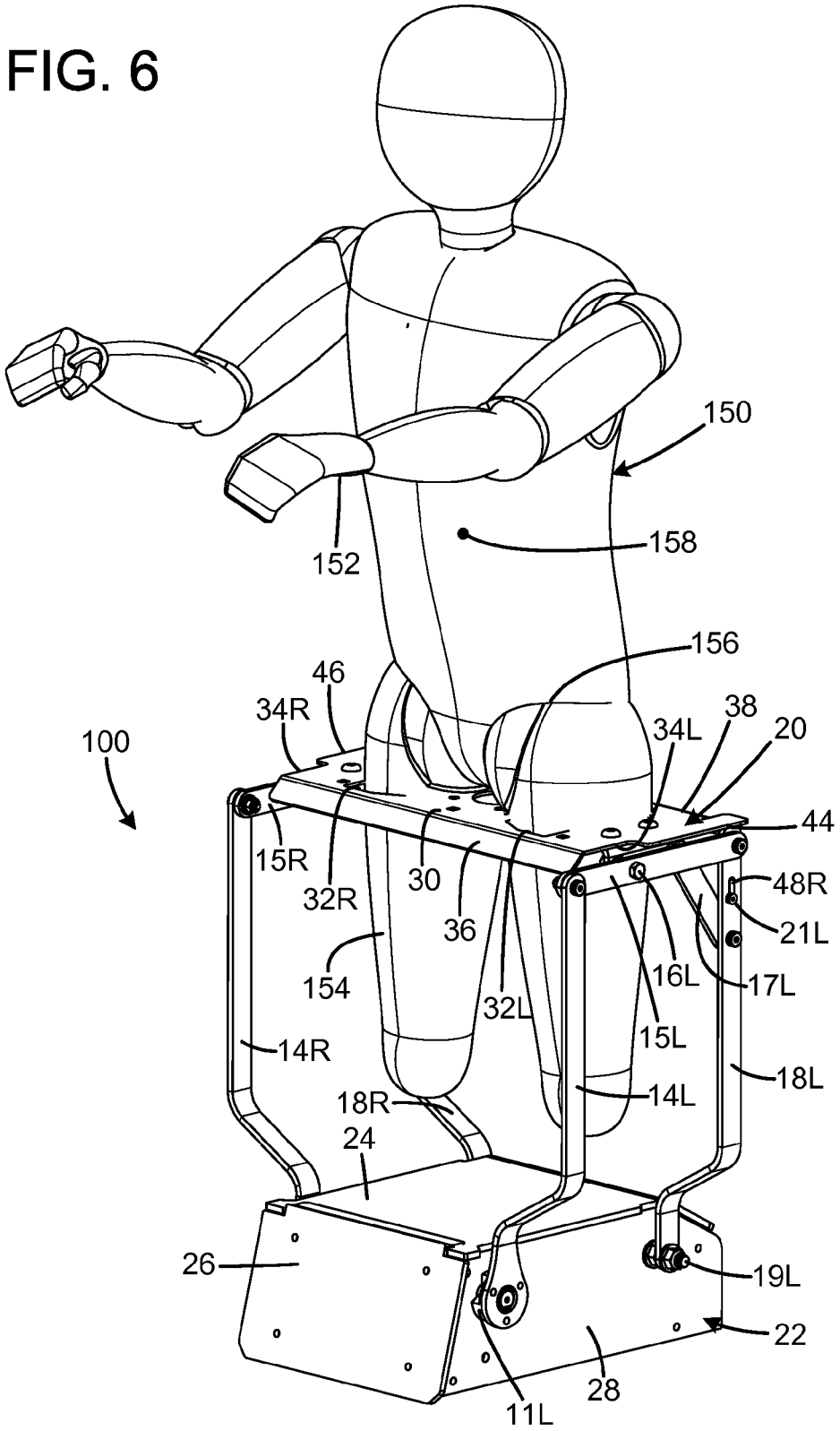
FIG. 6 is a top perspective view of the weaponry target mechanism of the present invention in the upright position with an attached mannequin having arms and legs.
Figure 7:
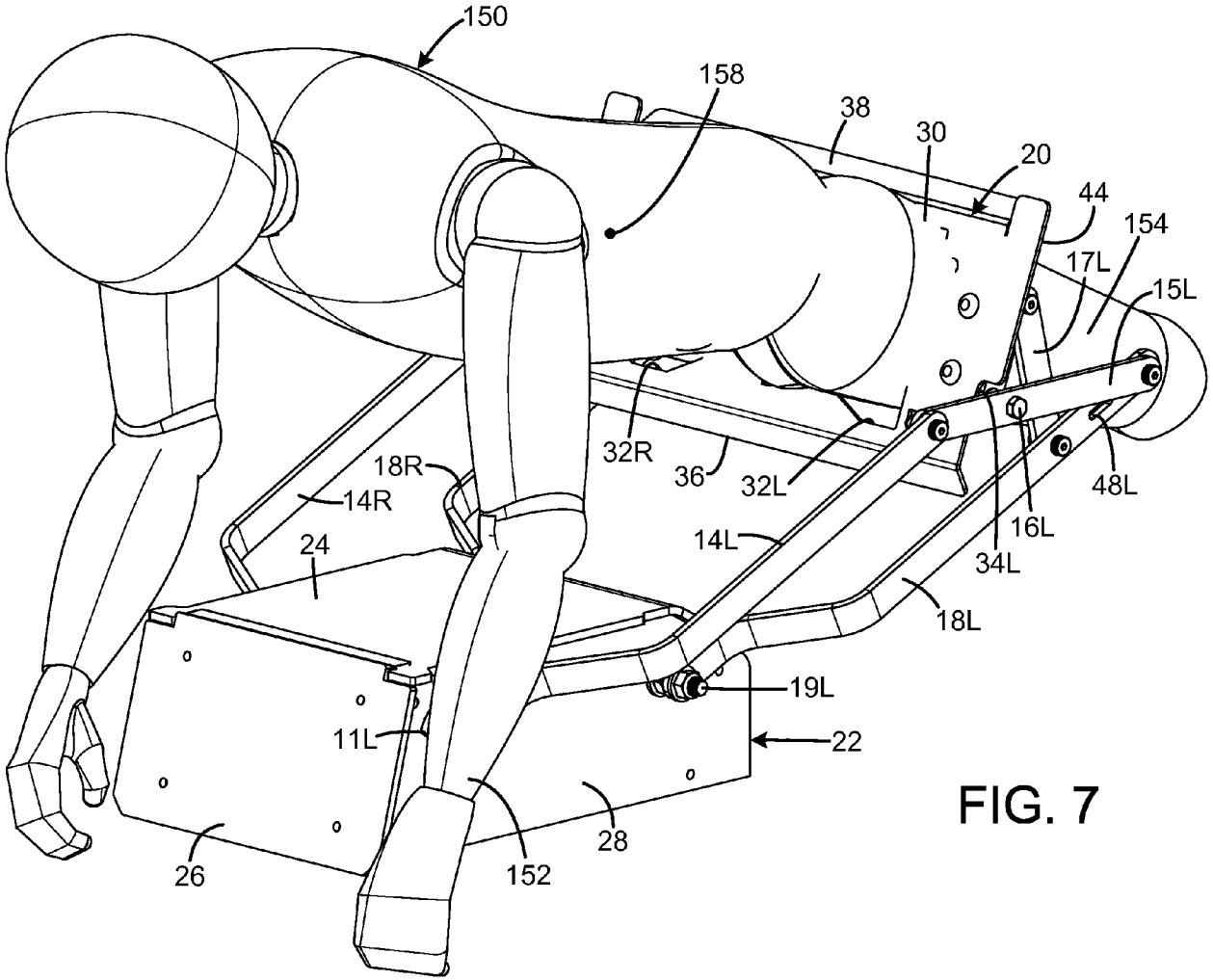
FIG. 7 is a top perspective view of FIG. 6 in the dropped position.

FIGS. 6-7 illustrate the improved weaponry target mechanism 100 of the present invention. More particularly, the mechanism is shown with a target mannequin 150 attached to the target mounting plate 20 at the approximate location of the mannequin's waistline 156. FIG. 6 shows the mannequin in the standing or "alive" condition. FIG. 7 shows the mannequin attached to the target mounting plate in the collapsed or "killed" position. The mannequin has arms 152, legs 154, and a center of mass 158. The legs of the mannequin are inserted through leg holes 32R, 32L in the mounting plate 20 to releasably secure the mannequin to the mechanism.

Figure 8:
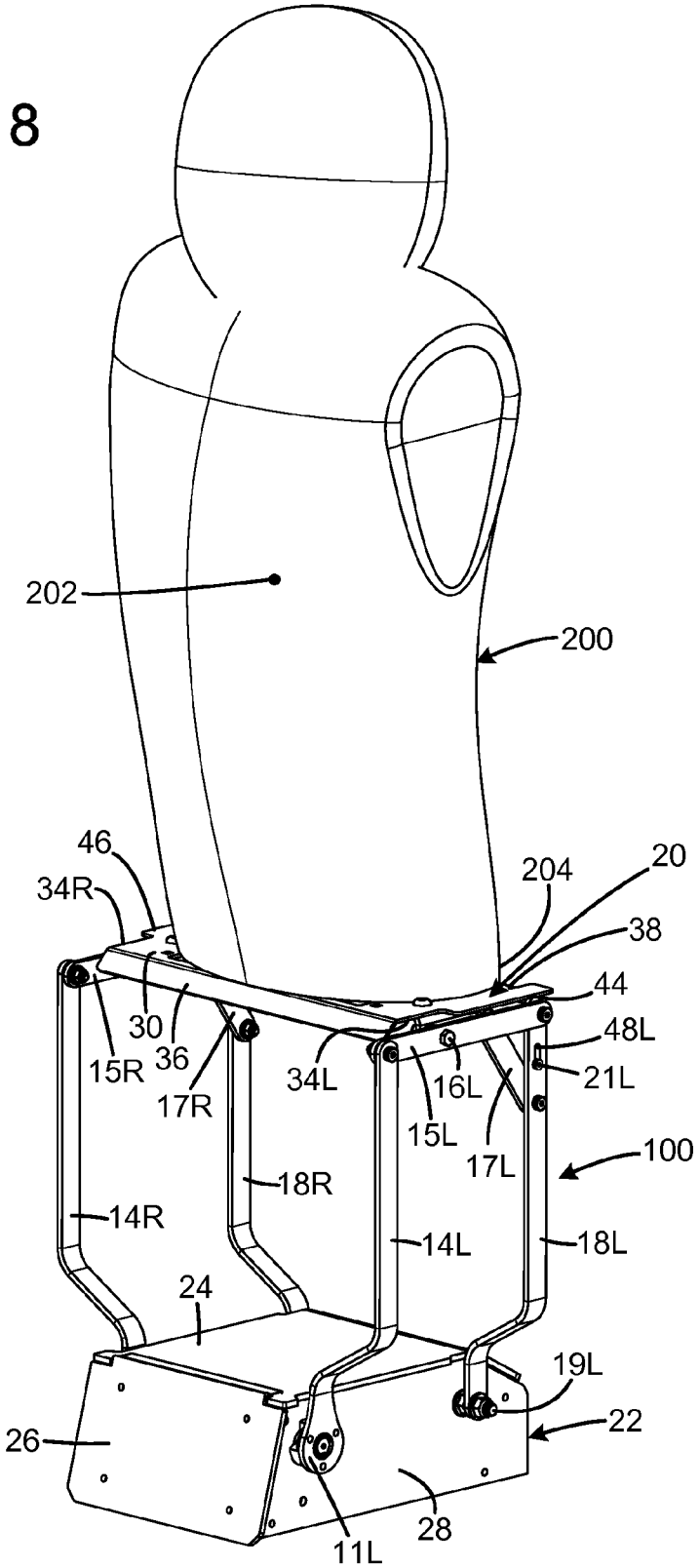
FIG. 8 is a top perspective view of the target mount of the present invention in the upright position with an attached standard military-style mannequin.
Figure 9:
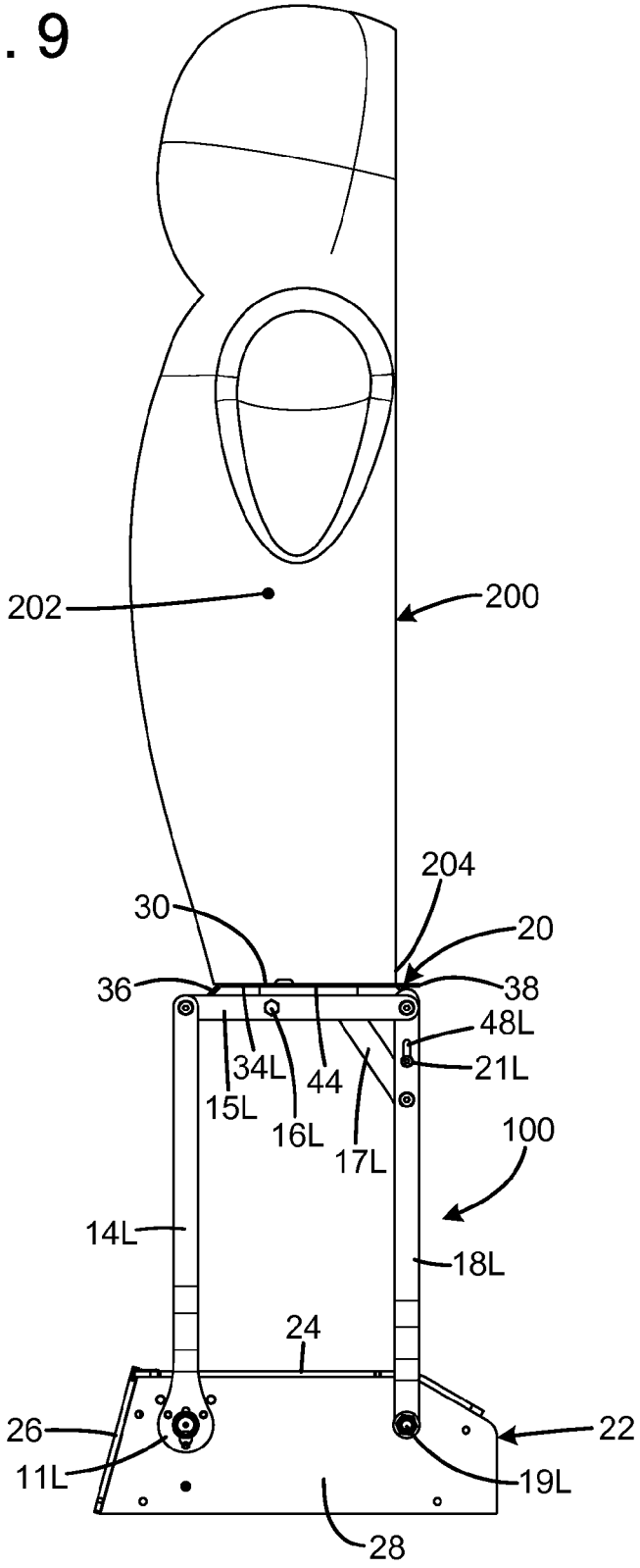
FIG. 9 is a side view of FIG. 8 in the upright position.
Figure 10:
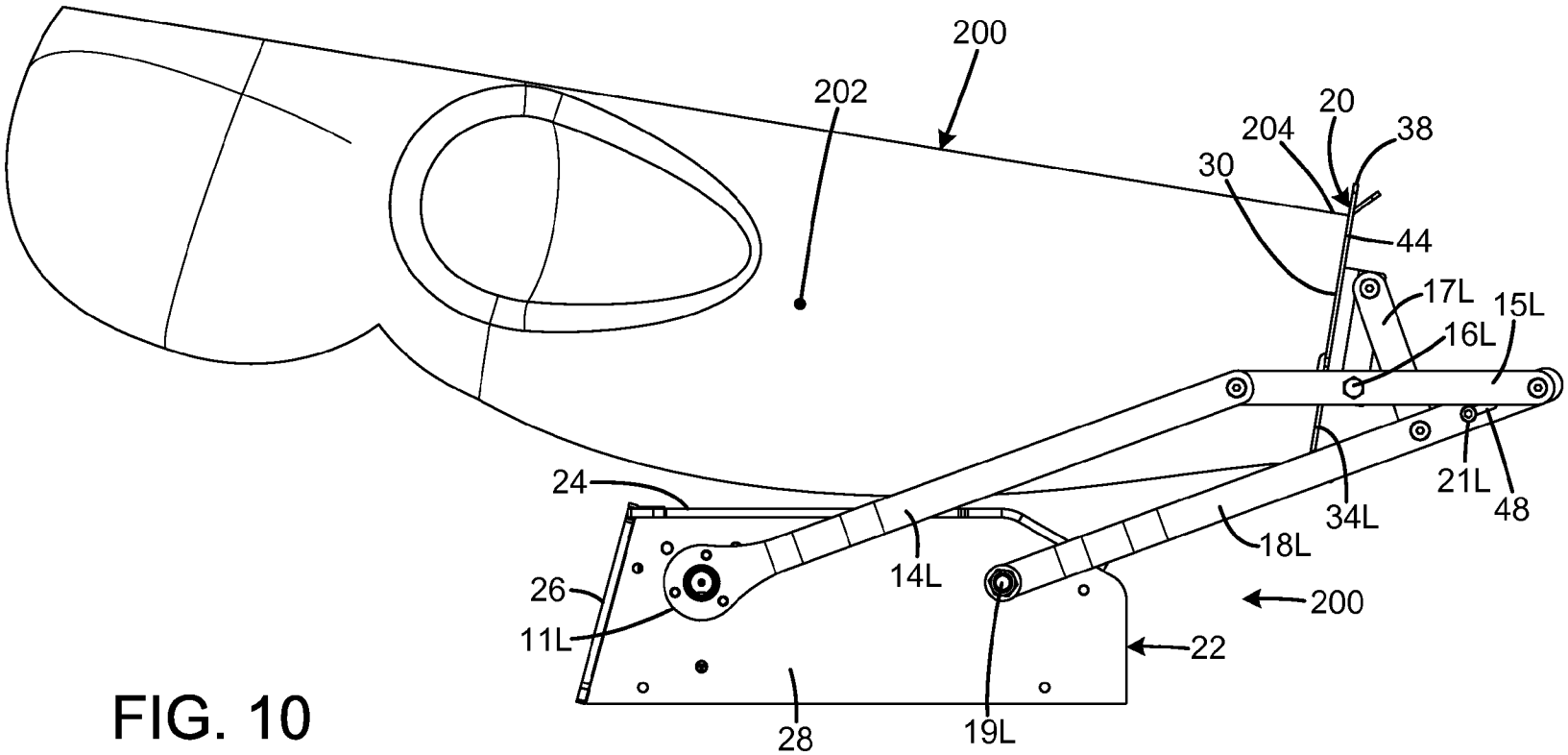
FIG. 10 is a top perspective view of FIG. 8 in the dropped position.

FIGS. 8-10 illustrate the improved weaponry target mechanism 100 of the present invention. More particularly, the mechanism is shown with a target mannequin 200 attached to the target mounting plate 20 at the approximate location of the mannequin's waistline 204. FIGS. 8-9 show the mannequin in the standing or "alive" condition. FIG. 10 shows the mannequin attached to the target mounting plate in the collapsed or "killed" position. The mannequin has a center of mass 202.

Figure 11:
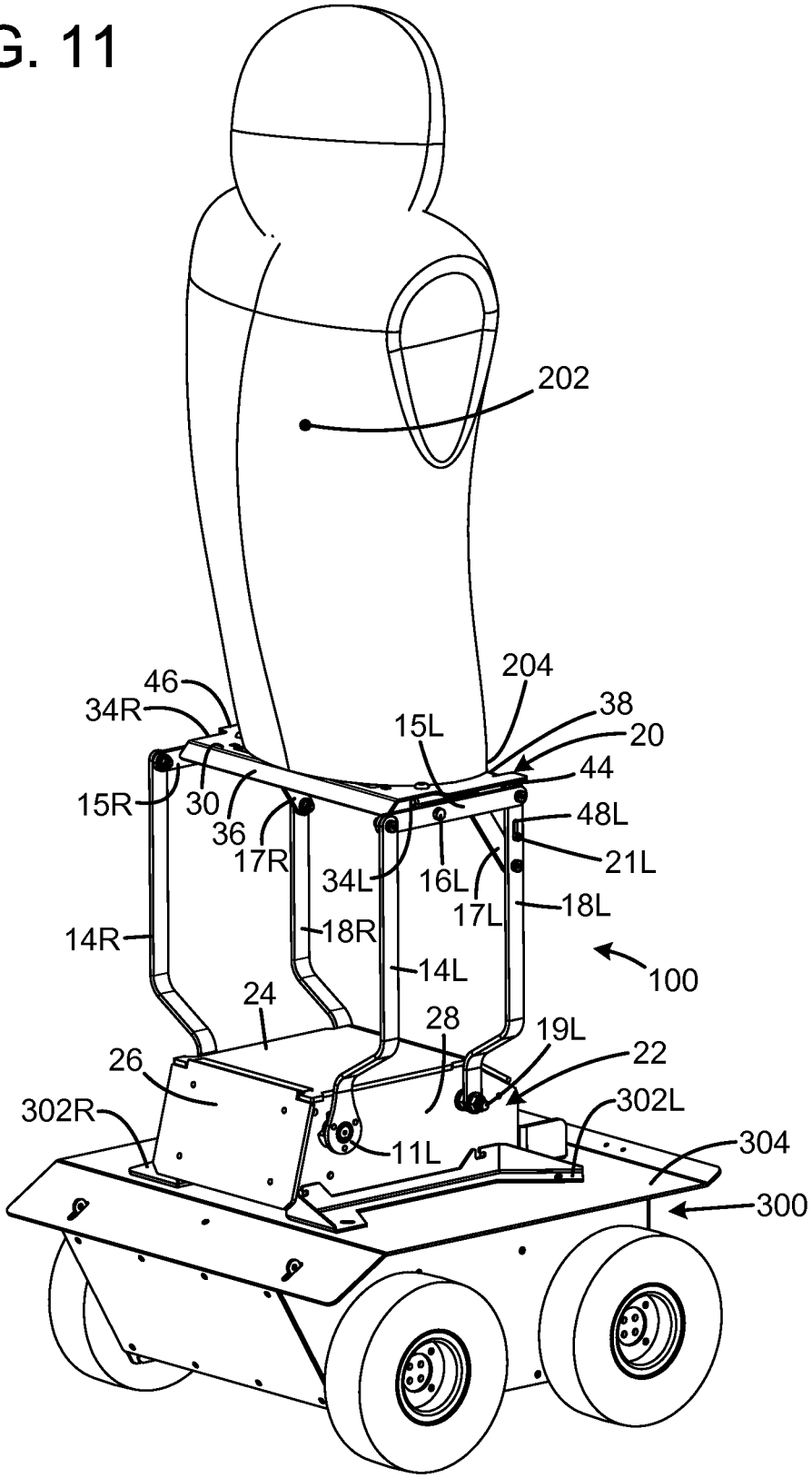
FIG. 11 is a top perspective view with the weaponry target mechanism of FIG. 8 mounted on a moving platform.
Figure 12:
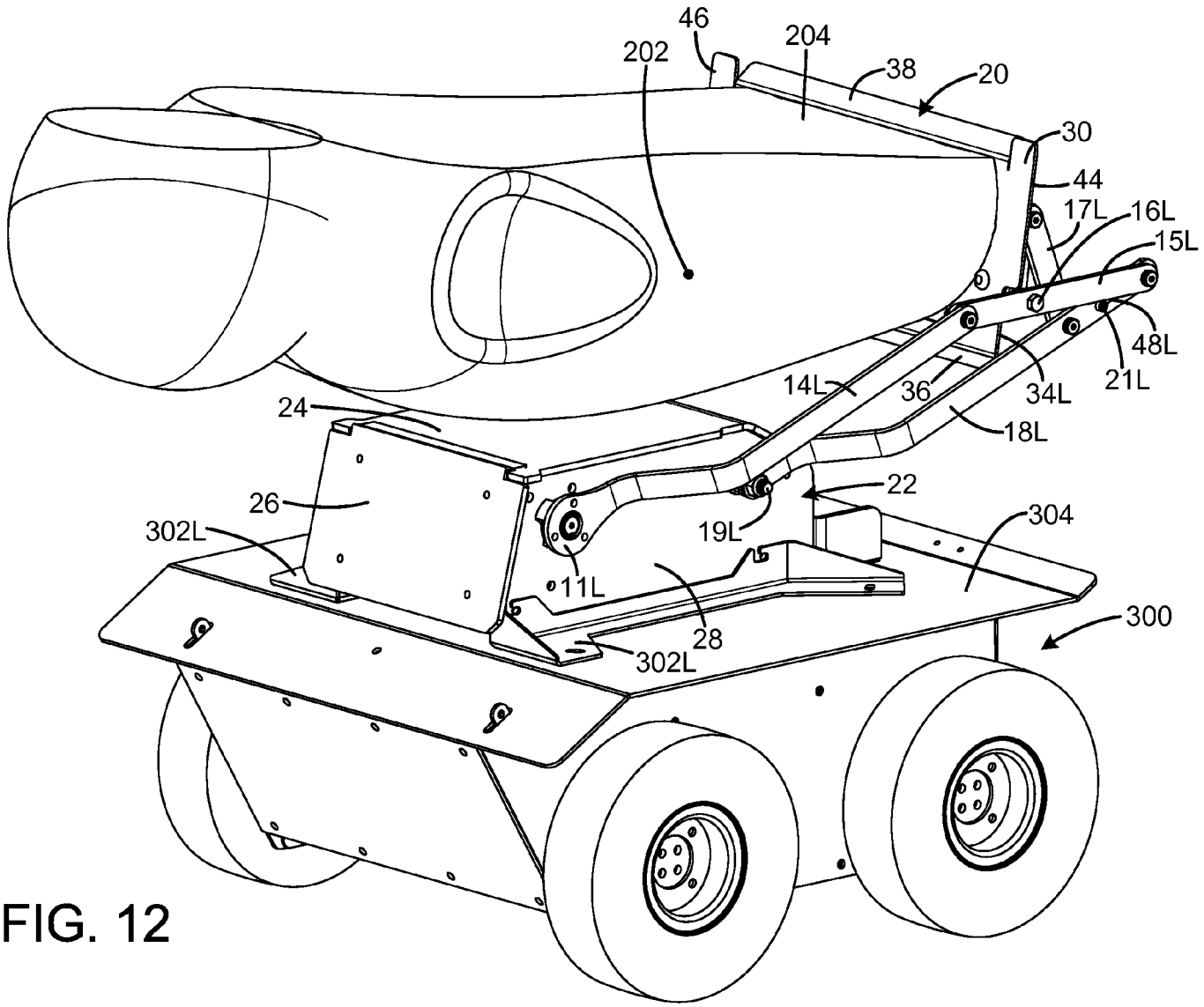
FIG. 12 is a top perspective view of the weaponry target mechanism of FIG. 11 in the dropped position.

FIGS. 11-12 illustrate the improved weaponry target mechanism 100 of the present invention. More particularly, the mechanism is shown mounted on a moving platform 300. The mechanism is depicted with a target mannequin 200 attached to the target mounting plate 20 at the approximate location of the mannequin's waistline 204. FIG. 11 shows the mannequin in the standing or "alive" condition. FIG. 12 shows the mannequin attached to the target mounting plate in the collapsed or "killed" position. The mannequin has a center of mass 158. The mechanism is releasably secured to the top 304 of the moving platform by mounting brackets 302R, 302L.

As is shown in FIGS. 7, 10, and 12, when a mannequin 150, 200, or other suitable weapons target is attached to the target mounting plate 20, the net motion effect of the mounting plate when the mannequin is hit is to lower the mannequin while simultaneously pitching the mannequin forward. Shifts in the center of mass 158, 202 are reduced or eliminated (the center of mass of the target remains within a vertical plane that is perpendicular to the housing in both the upright and dropped positions), and the total space required to operate the device is minimized because of the forward motion of the mannequin. The feedback sensor 12 provides accurate position information to the control electronics 52, which enables the control electronics to operate the actuator 10 to precisely control the speed and position of the mannequin by controlling the rotation direction and speed of the shaft.

While a current embodiment of a weaponry target mechanism has been described in detail, it should be apparent that modifications and variations thereto are possible, all of which fall within the true spirit and scope of the invention. For example, although mannequin-style targets have been described, the mechanism is suitable for use with any type of weapons target. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A weaponry target mechanism comprising:

a base having two pivot points;

two support arms each pivotally connected to one of the pivot points;

a third arm pivotally connected to the two support arms;

a platform pivotally connected to the third arm and pivotally connected by a fourth arm to one of the support arms;

a target attached to the platform;

wherein the platform is movable with respect to the base such that the target assumes an upright position in which the target is in a first pivotal orientation and a dropped position in which the target is in a second pivotal orientation pivotally offset from the first pivotal orientation; and wherein the platform is rotationally moveable with respect to the base such that the platform is parallel to the base in the upright position and the platform is not parallel to the base in the dropped position and wherein the platform moves downward and laterally when the target transitions from the upright position to the dropped position so the target remains substantially over the base.

2. The mechanism of claim 1 further comprising:

a shaft connected to one of the pivot points; and an actuator operable to rotate the shaft.

3. The mechanism of claim 2 further comprising:

a position feedback sensor mounted on the shaft;

a controller connected to the sensor and to the actuator; and wherein the controller operates the actuator to control the rotation direction and speed of the shaft.

4. The mechanism of claim 1 further comprising:

the base having two additional pivot points;

two additional support arms each pivotally connected to one of the additional pivot points;

an additional third arm pivotally connected to the two additional support arms; and the platform also being pivotally connected to the additional third arm and pivotally connected by an additional fourth arm to one of the additional support arms.

5. The mechanism of claim 1 wherein the target is substantially vertical in the upright position and substantially horizontal in the dropped position.

6. The mechanism of claim 1 wherein the target has a center of mass that remains in a vertical plane with respect to the base in both the upright position and the dropped position.

7. The mechanism of claim 1 wherein the two support arms, the third arm, and the base combined to form a four-sided polygon with a pivot point at each corner.

8. A weaponry target mechanism comprising:

a base having two pivot points;

two support arms each pivotally connected to one of the pivot points;

a third arm pivotally connected to the two support arms;

a platform pivotally connected to the third arm and pivotally connected by a fourth arm to one of the support arms;

a target connected to the platform;

wherein the platform is movable with respect to the base such that the target assumes an upright position in which the target is in a first pivotal orientation and a dropped position in which the target is in a second pivotal orientation pivotally offset from the first pivotal orientation;

the target defining a major plane, the major plane facing laterally when the platform is in the upright position, and facing in a different direction when the platform is in the dropped position; and wherein the platform is rotationally moveable with respect to the base such that the platform is parallel to the base in the upright position and the platform is not parallel to the base in the dropped position and wherein the platform moves downward and laterally when the target transitions from the upright position to the dropped position so the target remains substantially over the base.

9. The mechanism of claim 8 further comprising:

a shaft connected to one of the pivot points; and an actuator operable to rotate the shaft.

10. The mechanism of claim 9 further comprising:

a position feedback sensor mounted on the shaft;

a controller connected to the sensor and to the actuator; and wherein the controller operates the actuator to control the rotation direction and speed of the shaft.

11. The mechanism of claim 8 further comprising:

the base having two additional pivot points;

two additional support arms each pivotally connected to one of the additional pivot points;

an additional third arm pivotally connected to the two additional support arms; and the platform also being pivotally connected to the additional third arm and pivotally connected by an additional fourth arm to one of the additional support arms.

12. The mechanism of claim 8 wherein the target is substantially vertical in the upright position and substantially horizontal in the dropped position.

13. The mechanism of claim 8 wherein the target has a center of mass that remains in a vertical plane with respect to the base in both the upright position and the dropped position.

14. The mechanism of claim 8 wherein the two support arms, the third arm, and the base combined to form a four-sided polygon with a pivot point at each corner.

15. A weaponry target mechanism comprising:

a base having two pivot points;

two support arms each pivotally connected to one of the pivot points;

a third arm pivotally connected to the two support arms;

a platform pivotally connected to the third arm and pivotally connected by a fourth arm to one of the support arms;

the platform being operable to move between a first elevated position in which the platform is in a first pivotal orientation and a second lowered position in which the platform is in a second pivotal orientation pivotally offset from the first pivotal orientation; and wherein the platform is rotationally moveable with resect to the base such that the platform is parallel to the base in the upright position and the platform is not parallel to the base in the dropped position and having a torso target attached to the platform.

16. The mechanism of claim 15 further comprising:

a shaft connected to one of the pivot points; and an actuator operable to rotate the shaft.

17. The mechanism of claim 16 further comprising:

a position feedback sensor mounted on the shaft;

a controller connected to the sensor and to the actuator; and wherein the controller operates the actuator to control the rotation direction and speed of the shaft.

18. The mechanism of claim 15, further comprising the platform including an attachment facility operable to connect a target in the form of a torso to the platform.

19. The mechanism of claim 15 further comprising:

the base having two additional pivot points;

two additional support arms each pivotally connected to one of the additional pivot points;

an additional third arm pivotally connected to the two additional support arms; and the platform also being pivotally connected to the additional third arm and pivotally connected by an additional fourth arm to one of the additional support arms.

20. The mechanism of claim 15 wherein the target is substantially vertical in the upright position and substantially horizontal in the dropped position.

21. The mechanism of claim 15 wherein the target has a center of mass that remains in a vertical plane with respect to the base in both the upright position and the dropped position.

22. The mechanism of claim 15 wherein the platform moves downward and rearward when the target transitions from the upright position to the dropped position so the target remains substantially over the base.

23. The mechanism of claim 15 wherein the two support arms, the third arm, and the base combined to form a four-sided polygon with a pivot point at each corner.

* * * * *